US005428430A

United States Patent [19]

Aslam et al.

[11] Patent Number: 5,428,430

[45] Date of Patent: Jun. 27, 1995

[54] IMAGE FORMING METHOD AND APPARATUS USING AN INTERMEDIATE

[75] Inventors: Muhammad Aslam; Lawrence P. DeMejo; Alec N. Mutz; Kevin M. Johnson, all of Rochester, N.Y.

[73] Assignee: Eastman Kodak Company, Rochester, N.Y.

[21] Appl. No.: 843,666

[22] Filed: Feb. 28, 1992

[51] Int. Cl.[6] ..... G03G 15/14

[52] U.S. Cl. ..... 355/272; 355/271; 355/326 R

[58] Field of Search ..... 355/271, 274, 279, 282, 355/285, 290, 326 R, 327, 272, 277; 430/126, 99; 118/60

[56] References Cited

U.S. PATENT DOCUMENTS

| | | | |
|---|---|---|---|
| 3,893,761 | 7/1975 | Buchan et al. | 355/272 |
| 3,948,215 | 4/1976 | Namiki | 118/60 |
| 4,068,937 | 1/1978 | Willemse et al. | 355/212 |
| 4,341,455 | 7/1982 | Fedder | 355/274 |
| 4,401,383 | 8/1983 | Suzuki et al. | 355/272 |
| 4,453,820 | 6/1984 | Suzuki | 355/279 |
| 4,455,079 | 6/1984 | Miwa et al. | 355/279 |
| 4,518,976 | 5/1985 | Tarumi et al. | 346/153.1 |
| 4,531,825 | 7/1985 | Miwa et al. | 355/279 |
| 4,542,978 | 9/1985 | Tarumi et al. | 355/279 |
| 4,588,279 | 5/1986 | Fukuchi et al. | 355/271 |
| 4,657,373 | 4/1987 | Winthaegen et al. | 355/275 |
| 4,737,433 | 4/1988 | Rimai et al. | 430/111 |
| 4,755,849 | 7/1988 | Tarumi et al. | 355/290 |
| 4,833,060 | 5/1989 | Nair et al. | 430/137 |
| 4,910,558 | 3/1990 | Giezeman et al. | 355/279 |
| 4,912,514 | 3/1990 | Mizutani | 355/272 |
| 4,927,727 | 5/1990 | Rimai et al. | 430/99 |
| 4,931,839 | 6/1990 | Tompkins et al. | 355/277 |
| 4,968,578 | 11/1990 | Light et al. | 430/126 |
| 4,984,026 | 1/1991 | Nishise et al. | 430/126 X |
| 4,992,833 | 2/1991 | Derimiggio | 355/282 |
| 5,021,835 | 6/1991 | Johnson | 355/271 |
| 5,023,038 | 6/1991 | Aslam et al. | 264/293 |
| 5,093,689 | 3/1992 | Imaeda | 355/279 |
| 5,119,140 | 6/1992 | Berkes et al. | 355/273 |

FOREIGN PATENT DOCUMENTS

| | | |
|---|---|---|
| 0295901 | 12/1988 | European Pat. Off. . |
| 0301585 | 2/1989 | European Pat. Off. . |
| 1-179181 | 7/1989 | Japan . |

OTHER PUBLICATIONS

U.S. patent application Ser. No. 07/603,068, Rimai et al, filed Oct. 25, 1990.

U.S. patent application Ser. No. 07/405,258 to Rimai et al.

U.S. patent application Ser. No. 07/612,948, filed Nov. 13, 1990 (CIP of U.S. patent application Ser. No. 07/448,487).

*Primary Examiner*—A. T. Grimley
*Assistant Examiner*—Sandra L. Brase
*Attorney, Agent, or Firm*—Leonard W. Treash

[57] ABSTRACT

An image forming apparatus includes a source of at least one intermediate sheet which is preferably both thermally and electrically conductive. Toner images are transferred from one or more image members to the intermediate sheet under conditions of raised temperature and preferably with the assistance of an electric field. The toner image on the intermediate sheet is then overlaid with a receiving sheet and a combination of heat and pressure transfers and fuses the toner image to the receiving sheet in a single step, preferably while the sheets move at full machine speed. The sheets may then be slowed down or stopped, but are maintained together until cool at which point they are separated and the intermediate sheet fed back to the source of intermediate sheets. The image forming apparatus is particularly useful in creating multicolor toner images with small toners.

39 Claims, 3 Drawing Sheets

IMAGE FORMING METHOD AND APPARATUS USING AN INTERMEDIATE

RELATED APPLICATIONS

This application is related to co-assigned:

U.S. patent application Ser. No. 07/843,664, filed Feb. 28, 1992, METHOD AND APPARATUS OF TRANSFERRING TONER IMAGES MADE UP OF SMALL DRY PARTICLES, in the name of Aslam et al.

TECHNICAL FIELD

This invention relates to the use of an intermediate in toner image formation. Although not limited thereto, the invention is particularly usable in forming a multicolor image on an intermediate by heat assisted transfer, in registration, of more than one single color toner image, and to the transfer and fusing of such multicolor image in a single step from the intermediate to a receiving sheet. Although not limited thereto, it is particularly usable with small, dry toner particles.

BACKGROUND ART

The transfer of small, dry toner particles, for example, toner particles of less than 5 microns in size from a photoconductor or other image member to a receiving sheet is extremely challenging. Studies on the forces which move small particles indicate that as the particle becomes smaller the effect of an electrostatic field is less on a particle compared to the effect of ordinary adhesive forces. This has made conventional transfer using an electrostatic field relatively ineffective in transferring such small particles. See, U.S. Pat. No. 5,084,735, Rimai et al, issued Jan. 28, 1992 and U.S. Pat. No. 4,737,433, Rimai et at.

U.S. Pat. No. 4,968,578, Light et at, issued Nov. 6, 1990; U.S. Pat. No. 4,927,727, Rimai et al, issued May 22, 1990; and U.S. Pat. No. 5,021,835, Johnson, issued Jun. 4, 1991, all describe a heat assisted toner image transfer method particularly usable with small particles. Two or more single color images are transferred in registration from an image member to a receiving sheet by heating the receiving sheet to an elevated temperature. The temperature of the receiving sheet is sufficiently high that the toner sticks to the receiving sheet and to itself. Preferably, the receiving sheet is heated from inside a transfer drum to which it is secured. The transfer drum and image member form a pressure nip with the combination of heat and pressure transferring the image. This method is particularly useful in transferring extremely small, dry toner particles, for example, toner particles having a mean particle diameter of 5 microns or less.

In a preferred form of the heat assisted transfer described in these references a receiving sheet having a heat-softenable outer layer is used. The receiving sheet is heated to a temperature which softens the outer layer and the first layer or layers of the toner images partially embed themselves in the heat-softened layer to assist in transfer of the first image or so. Further layers of toner from subsequent images or dense portions of the first image attach themselves to toner particles that are partially embedded. With extremely small, dry toner particles this method provides extremely efficient transfer with excellent resolution.

Although heat assisted transfer to a heat-softened layer provides the most efficient and highest resolution transfer of very small toner particles known in the prior art, it is not without problems. Depending somewhat on the materials, relatively high pressures are desirable, for example, pressures of up to 500 pounds per square inch and higher. Heating is accomplished generally through the receiving sheet. Even if the receiving sheet is carried on a metallic drum, it is somewhat difficult to maintain the temperature of the thermoplastic layer within limits that will sinter the toner without overheating the image member or blistering the receiving sheet. Overheating of the image member can cause damage to it, including a reduction of its ability to hold a charge. Overheating of the toner image can cause sticking to the image member and/or spreading of the image. It is known to provide a heating element inside a photoconductive drum which heats the drum to an elevated but safe temperature for the image member and thereby requires less heating from the transfer member. Even with this useful approach, temperature control at transfer is difficult with a receiving sheet receiving the images from a photoconductor.

Especially in transferring a series of single color toner images to form a multicolor toner image, the layers of toner pile up above the level of the receiving sheet even when substantial pressure is used in transfer and with a heat-softened layer receiving the toner. This results in an unacceptable relief image corresponding generally to the optical density of the image. U.S. Pat. No. 5,023,038 to Aslam et at, issued Jun. 11, 1991 and U.S. Pat. No. 5,089,363 to Rimai et al describe a method of fixing such toner images to a receiving sheet which receiving sheet has an outer heat-softenable thermoplastic layer. The relief image is substantially reduced, the image is more permanently fixed and gloss can be increased by bringing the image into contact with a ferrotyping surface under conditions of heat and pressure which cause the image to be further embedded in the thermoplastic layer. The ferrotyping surface is smooth and hard and has good release characteristics. For example, it can be made of nickel, stainless steel or other metals, with or without surface treating with silicones or the like. For highest quality imaging, the ferrotyping surface is left in contact with the image until the image and heat-softened layer have cooled below their glass transition temperatures, at which point it is separated without offset.

The use of endless belts generally to fix regular toner images directly to paper, transparency stock, or the like has been known for many years; see, for example, U.S. Pat. No. 3,948,215; European Applications 0301585 and 0295901. Typically, in all of the above fixing processes the toner image is left in contact with the web until the image is cooled below the glass transition temperature of the toner, at which point the receiving sheet can be separated without offset. Preventing offset by cooling in contact with the web eliminates the need for offset preventing liquids which have a degrading effect on a high-quality image.

A problem in using a web system, especially an endless belt system, in a productive image forming apparatus is associated with the time required for the belt and image to cool while maintained in contact. If the fixing device is slowed down to below the speed of the transfer station to allow cooling, then the mismatch of speeds between the transfer station and the fixing device must be accommodated. In general, this requires either a full frame distance in the in-track direction between the transfer station or drum and the fixing device, or loop or other mechanism for absorbing the difference in speeds.

Belt fixing devices create other non-trivial problems. For example, belt tracking must be controlled. The belts are expensive and difficult to replace. If the belt has a seam the timing of the apparatus must be controlled to prevent the seam appearing in the middle of an image. The convenient availability of different textures is accomplished generally by exchanging belts, a task which is time consuming and especially difficult if the apparatus is hot. The belt has very limited room inside it for cooling structure.

An intermediate transfer member (sometimes herein called an "intermediate") has been used in both single color electrophotography and multicolor electrophotography. For example, U.S. Pat. No. 4,931,839, shows the use of an intermediate conductivity intermediate web to accumulate several single color toner images by separate electrostatic transfer from a photoconductive web. The multicolor image formed on the intermediate is electrostatically transferred to a receiving sheet and later fed to a separate fixing station.

A number of references show single color transfer to an intermediate and then a combined step including simultaneous fixing and transfer under heat and pressure from the intermediate to a receiving sheet. See, for example, U.S. Pat. No. 4,657,373; U.S. Pat. No. 4,068,937; U.S. Pat. No. 3,893,761; U.S. Pat. No. 4,453,820; and U.S. Pat. No. 4,542,978. In each of these references, the intermediate has a silicone rubber or other compliant surface which is used because of its affinity to toner at the first transfer step. At or before the second transfer step the image and, in some instances, the receiving sheet are preheated so that transfer and fusing can be accomplished in a single step. The intermediate is generally cooled before it returns to the original image member to pick up additional images for fear of damage to a photoconductor or other sensitive portion of the original image member.

U.S. Pat. Nos. 4,588,279; 4,455,079; and 4,518,976 maintain the receiving sheet in contact with the intermediate until the image has cooled before separation. As in the previous references, silicone rubber is generally used for the intermediate in order to accomplish pressure transfer without heat at the fast or original transfer.

U.S. Pat. No. 4,910,558 shows an intermediate drum which is internally heated and covered with compressible silicone rubber. A receiving sheet is preheated to the temperature of boiling water and pressure is used at both transfers.

U.S. Pat. No. 4,912,514 shows an intermediate web with a conductive base and a fluoride coating with separate rapid heating components opposite the original transfer from a photoconductive drum and opposite a combination transfer-fusing position where the single image is transferred to and fused to a receiving sheet. The first transfer is said in the reference to involve fusing the toner on a photosensitive drum until it transfers to and is temporarily fixed on the surface of the intermediate.

U.S. Pat. No. 4,531,825 shows an intermediate roller having a heat conductive core with a silicone or fluoride resin coating. The original image member has a soft backing providing a larger nip for the first transfer and the transferred image is fused and transferred to a preheated receiving sheet in a single step.

U.S. Pat. No. 4,992,833 shows an intermediate sheet or web to which a single toner image is transferred by means not described. After the transfer the image is fused to the intermediate and kept warm until overlaid with a receiving sheet. The receiving sheet and intermediate are cooled together before separation. The intermediate is cleaned for reuse.

U.S. patent application No. 612,948, filed Nov. 13, 1990 (CIP of U.S. patent application No. 448,487, now abandoned) to Y. Ng discloses using thermally assisted transfer for three or four small particle color toner transfers to an intermediate and a combination transfer and fuse of the resulting multicolor image to a receiving sheet.

Japanese Kokai 1-179181; published Jul. 17, 1989, shows a combination of heat and electric field used to transfer a toner image to a receiving sheet carried by either a drum or belt. The image is fixed while the receiving sheet is still on the drum or belt by pressure contact with a heated roller.

SUMMARY OF THE INVENTION

In the prior art devices in which transfer and fusing from an intermediate is done in a single step and the receiving sheet is kept in contact with the intermediate until cool, the intermediate is generally a long belt or is carried by a long belt.

It is an object of the invention to provide a method of forming a fixed toner image which method uses an intermediate and combines transfer and fusing as in some of the prior art, but which has advantages in one or more of compactness, speed and convenience over the prior art. Although not limited thereto, it is particularly usable in forming high quality, fused multicolor images, particularly with very small, dry toner particles.

This and other objects are accomplished by method and apparatus in which a toner image is formed on an image member and transferred to an intermediate sheet. The toner image is overlaid with a receiving sheet, and a combination of heat and pressure is used to transfer and fix the toner image to the receiving sheet in a single step. The intermediate and receiving sheet are allowed to cool while separated from the pressure applying means and are separated from each other only after such cooling.

According to a preferred embodiment, the invention provides remarkable results in a method and apparatus in which a series of single color, different color toner images are formed on one or more image members. These images are transferred in registration to a surface of an intermediate sheet. The surface to which the images are transferred is hard and smooth. For example, it is preferably a metal surface of an entirely metal sheet. The images are transferred by heating the intermediate sheet to a temperature sufficient to at least sinter portions of the toner image and applying an electric field urging transfer. A multicolor image is formed on the intermediate sheet. A receiving sheet is overlaid the multicolor toner image and the intermediate and receiving sheet are fed as a sandwich between pressure members in the presence of sufficient heat and pressure to transfer and fix the multicolor toner image to the receiving sheet. The receiving sheet and intermediate are allowed to cool as a unit separate from the pressure members and then are separated.

Using an intermediate in sheet form, the intermediate can be heated for two transfers predominantly from a single source and the pressure applied for the fixing step at ordinary machine speed but the combination of the intermediate sheet and receiving sheet can be allowed to cool (or be actively cooled) at a slower speed. This allows the cooling to be accomplished without inordinately enlarging the apparatus. It provides the space and heat conservation of transfixing with the offset preventing advantages associated with cooling before separation without either slowing the main apparatus or elongating the intermediate.

According to another preferred embodiment, the intermediate sheet can be wrapped around a transfer drum and recycled past one or more image members. This provides the registration advantages of a drum not usually obtainable in transfixing devices that require cooling before separation.

DESCRIPTION OF THE PREFERRED EMBODIMENTS

FIGS. 1, 3, 4 and 5 illustrate alternative image forming apparatus using toner image transfer intermediates. Preferably, each of the intermediates is conductive and image transfer to the intermediates is accomplished in the presence of heat and an electric field according to a process described more thoroughly below. The image on the intermediate is transferred and fused in a single step to a receiving sheet and the receiving sheet and intermediate are maintained in contact until the image is cooled sufficiently for separation without offset.

The method and apparatus disclosed herein can be used with receiving sheets made of ordinary paper, transparency stock, highly finished paper and the like. However, the best results are obtained if the receiving sheet has a heat-softenable thermoplastic outer surface to which the image is transferred.

The apparatus will be described rust and the process of transferring toner images to the intermediate will be described later. The scope of the invention is defined in the claims.

Figure 1:
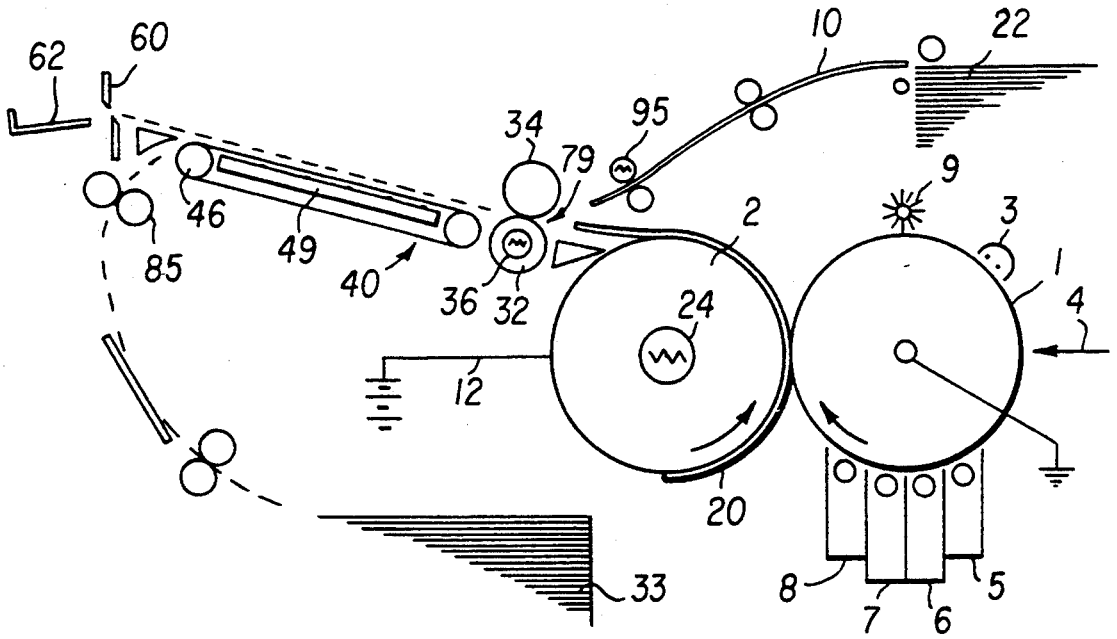
FIG. 1 is a side schematic of a multicolor image forming apparatus.

According to FIG. 1, an image member upon which electrostatic images can be formed can be of a variety or type including a drum or a belt. As shown in FIG. 1, an image member 1 is a drum which includes a photoconductive outer surface and which is rotatable past a series of stations. The stations include a charging station 3 which uniformly charges the photoconductive surface. A series of electrostatic images are formed by a suitable exposure means, for example, a laser 4, to create a series of electrostatic images on the photoconductive surface of image member 1. Each of the electrostatic images is toned by one of toning stations 5, 6, 7 or 8 to create a series of toner images. Toning stations 5, 6, 7 and 8 include toners of different colors, so that the series of electrostatic images are turned into a series of different color toner images. The electrostatic images could be formed by other methods, for example, non-electrophotographically by imagewise ion deposition.

An intermediate sheet 20 is fed out of an intermediate sheet supply 33 to the periphery of a transfer drum 2 where it is held by a vacuum, gripping fingers or other means. Drum 2 (which could also be an endless belt) is rotated a number of times to bring intermediate sheet 20 through transfer relation with the toner images carried on image member 1. Each toner image is transferred to intermediate sheet 20 on a separate revolution of drum 2 to overlay the toner images in registration to form a multicolor toner image. This transfer is assisted by heat from lamp 24 and an electrical field from a source of potential 12 urging transfer of the toner images to the intermediate sheet 20.

Intermediate sheet 20 is preferably conductive. For example, it can be made entirely of nickel from 3 to 10 mils in thickness. The surface of intermediate sheet 20 receiving the toner images is made hard and smooth. Drum 2 is also preferably metallic, allowing good conduction of heat from lamp 24 and also of the bias from potential source 12.

To provide a width of nip between image member 1 and intermediate sheet 20, image member 1 can include a compliant layer underneath suitable photoconductive and conductive layers. For example, image member 1 can be an aluminum drum to which is attached a thin compliant silicone rubber or other material and on top of which is stretched a web or sheet photoconductor having a grounded conductive backing layer. Transfer from image member 1 to intermediate sheet 20 can also be assisted by moderately heating image member 1 internally. However, as will be described later, this does not appear to be necessary using a metallic intermediate.

After more than one image has been transferred in registration to intermediate sheet 20 to form a desired multicolor image, a wedge or skive 15 is activated and moved into contact with drum 2 to separate intermediate sheet 20 therefrom. A receiving sheet 10 is fed from a receiving sheet supply 22 into overlying relation with the image on intermediate sheet 20 as these sheets enter a nip 79 between pressure rollers 32 and 34. At least one of the pressure rollers, for example, roller 32 is heated internally by a lamp 36 and sufficient pressure is applied between the rollers to effect transfer of the multicolor toner image to the receiving sheet.

Intermediate 20 and receiving sheet 10 form a sandwich which is fed by rollers 32 and 34 onto a transport 40 for transport away from heating lamps 36 and 24. Once free of rollers 32 and 34, the sandwich can be stopped while it cools or moved much slower by transport 40 allowing cooling at a slower speed which greatly shortens the path required for such cooling. During transport by transport 40 sheets 20 and 10 can be cooled by a forced air cooling mechanism 49 located inside transport 40. A cooling mechanism can also be located on the opposite side of the sandwich. Much greater flexibility in cooling is available with the sandwich not forced to move at the same speed as drum 2 and rollers 32 and 34.

Figure 2:
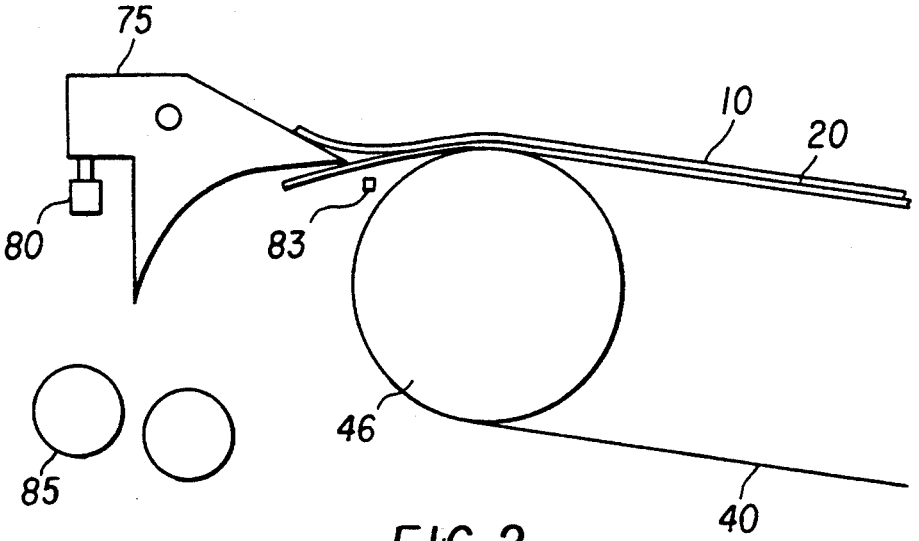
FIG. 2 is a side schematic of a portion of the apparatus shown in FIG. 1 illustrating the separation of intermediate and receiving sheets.

Once the toner image has been cooled below its glass transition temperature, the receiving sheet 10 is separated from the intermediate sheet 20 by a mechanism shown more clearly in FIG. 2. The leading edge of receiving sheet 10 is fed into nip 79 slightly behind the leading edge of intermediate 20. This feature is used in separation. Referring to FIG. 2, transport 40 includes a transport roller 46. As transport 40 moves the leading edges of receiving sheet 10 and intermediate sheet 20 past transport roller 46 the leading edge of sheet 20 is sensed by an optical or other suitable sensor 83. A separation pawl 75 is actuated by a solenoid 80 in response to sensor 83 to rotate clockwise into the leading portion of intermediate sheet 20 prior to arrival of the leading edge of receiving sheet 10. Pawl 75 substantially deflects intermediate sheet 20 from its path. The toner image having cooled below its glass transition temperature no longer holds these sheets together and the stiffness or beam strength of the receiving sheet 10 causes the two sheets to separate with the receiving sheet going above separation pawl 75 and the intermediate sheet 20 going below.

The receiving sheet 10 progresses on to be further treated. For example, it can be texturized at a station, not shown, or cut at a curing station 60 and ultimately placed in an output hopper 62. Meanwhile, intermediate sheet 20 proceeds into transport rollers 85 which ultimately feed it along a path back to intermediate sheet supply 33.

For highest quality work, receiving sheet 10 has a heat-softenable thermoplastic outer layer on its bottom side as seen in FIG. 1. The thermoplastic outer layer can be preheated by any suitable means, for example, by passing between a pair of rollers 95, one of which is heated or by a suitable shoe contacting the backside of receiving sheet 10 immediately before it enters nip 79. The thermoplastic outer layer is heated to its softening point either by the preheating device or by contact with intermediate 20 or by rollers 32 and 34 or a combination of these. The toner image is at least partially embedded in the thermoplastic layer as the sheets 10 and 20 pass between rollers 32 and 34 with any toner not so embedded leveled by pressure and heat in the same process. Because much of the toner is embedded rather than being spread by rollers 32 and 34 and because there is thermoplastic across the entire surface, both higher resolution and better gloss is obtained than without the heat-softenable layer. This surface can be textured or additional gloss applied to it in a subsequent treatment step after the receiving sheet 10 has been separated from intermediate 20, as is known in the art.

With this structure, drum 2 is moving at full machine speed at all times, for example, four inches per second. Pressure rollers 32 and 34 also would operate at the same speed as drum 2. This allows these rollers to be positioned adjacent drum 2 without a slack box or loop between drum 2 and rollers 32 and 34. Transport 40 can then be operated at one inch per second or slower or be stopped allowing the sandwich to cool adequately without slowing drum 2. With rollers 32 and 34 positioned close to drum 2, most of the heat passed to intermediate 20 by drum 2 is not lost. The overall result is a much more compact and heat-efficient apparatus than if a fusing belt were used for both the fixing and cooling steps. (Compare, for example, the structure shown in FIG. 5.)

Although intermediate sheet 20 and receiving sheet 10 can be fed into nip 79 with pressure rollers 32 and 34 permanently urged together, better results are obtained if these rollers are separated and moved together as the beginning of receiving sheet 10 reaches the center of the nip.

Figure 3:
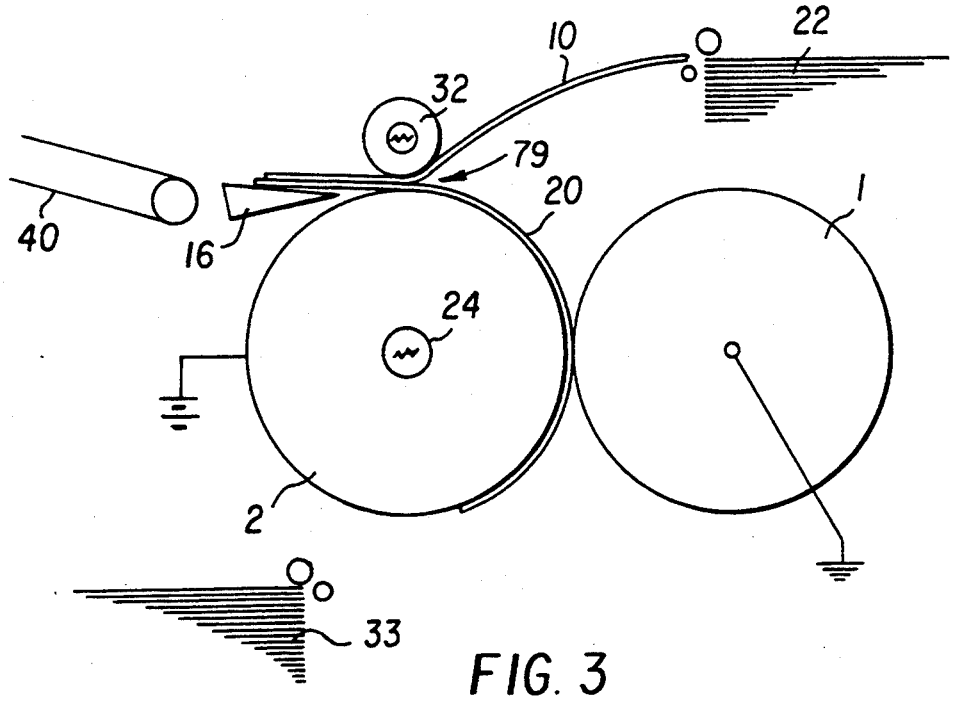

FIG. 3 shows an alternative embodiment of the structure shown in FIG. 1 in which image member 1 and drum 2 are identical in construction and operation with that in FIG. 1. However, the pressure rollers 32 and 34 have been replaced by a single articulatable pressure roller 32 which moves into pressure applying relationship with drum 2 after all images have been transferred to intermediate sheet 20.

More specifically, as the leading edge of intermediate sheet 20 leaves the transfer nip with image member 1 after the final single color image has been transferred to it producing the desired multicolor image, it approaches nip 79 established between drum 2 and heated pressure roller 32. A receiving sheet 10 is fed from receiving sheet supply 22 into overlying relation with the toner image as it enters nip 79. As the leading edge of receiving sheet 10 reaches the center of nip 79, pressure roller 32 is moved toward drum 2 with sufficient force to fuse the multicolor toner image to receiving sheet 10 as in the FIG. 1 embodiment. Again, receiving sheet 10 is preferably preheated by a suitable shoe or heated rollers, especially if receiving sheet 10 has a thermoplastic outer layer. The sandwich of intermediate sheet 20 and receiving sheet 10 is separated by articulatable skive 15 as in FIG. 1 and transported for cooling and separation by transport 40, also as in FIG. 1.

This embodiment has the advantage of fewer parts and more compactness. It also further conserves heat since intermediate sheet 20 has had no chance to cool by leaving drum 2 at all before the fusing step as in FIG. 1. For highest quality work with this embodiment, care must be taken to not disturb an exposure operation on image member 1 in creating further electrostatic images when articulatable heated roller 32 is moved into contact with receiving sheet 10. Although this can be accommodated by beginning the exposure of the next image after roller 32 is applying pressure to the receiving and intermediate sheets, movement of roller 32 away from drum 2 at the completion of the fixing may also have an effect on such exposure. Again, careful timing can prevent a injurious affect on the electrostatic image; for more details for such high-quality work, see U.S. Pat. No. 5,021,835, mentioned above.

Figure 4:
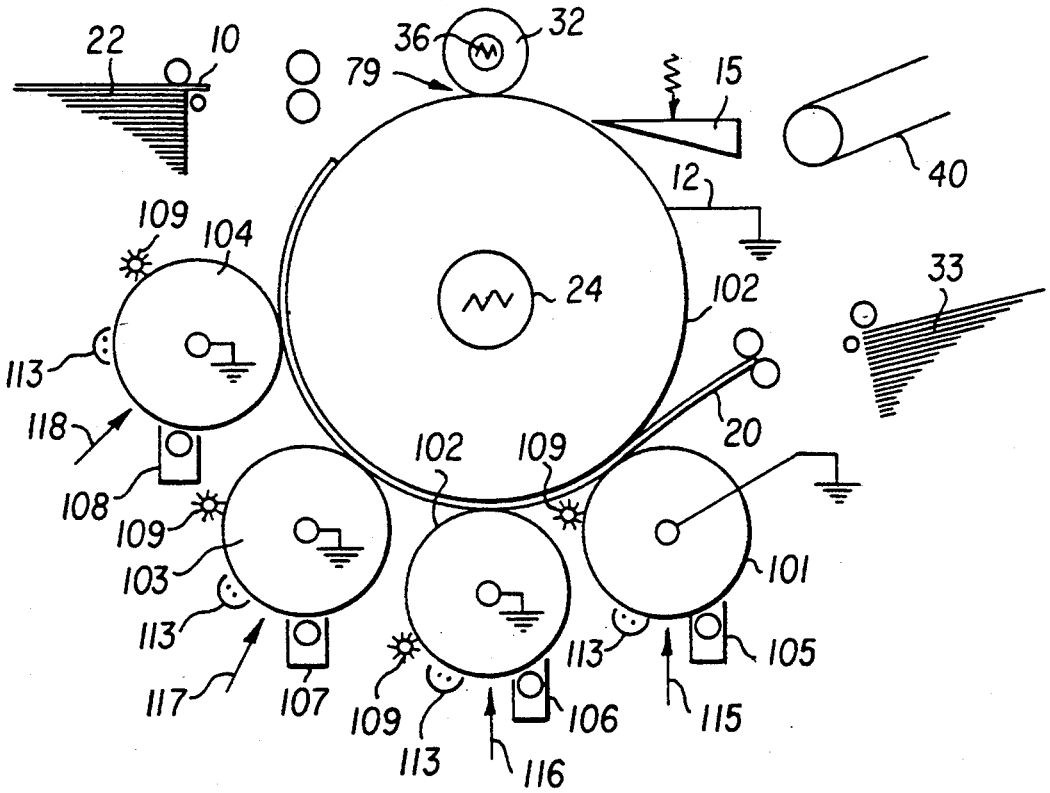
FIGS. 3, 4 and 5 are side schematics of alternative image forming apparatus.

FIG. 4 shows still another embodiment similar to the structure shown in FIGS. 1–3. In FIG. 4 image member 1 has been replaced by four image members 101, 102, 103 and 104, known generally in the art. Each of these image members can have a photoconductive outer surface or other means for forming electrostatic images. As shown in FIG. 4, each of the image members is uniformly charged by charging device 113 and is exposed by a suitable exposure device, for example, lasers 115, 116, 117 and 118 to create a single electrostatic image on each image member. Each electrostatic image is toned by one of toning stations 105, 106, 107 and 108. Each of the toning stations contains a different color toner to provide a different color toner image on each image member. The image members are continuously cleaned before charging by suitable cleaning devices 109.

Image member 1 is continuously cleaned by a suitable cleaning device 9.

An intermediate sheet 20 which is the same as the intermediate sheets used in FIGS. 1–3 is fed from intermediate supply 33 onto a large transfer drum 102 where it is held by vacuum, gripping fingers, or other suitable means. As in FIGS. 1–3, intermediate sheet 20 is heated by a lamp 24 inside transfer drum 102 to a temperature sufficient to raise the temperature of the toner images on each of the image members above their glass transition temperatures at least where the toner particles contact intermediate sheet 20 or each other. Transfer is further assisted by an electrostatic field between intermediate sheet 20 through drum 102 from voltage source 12. As in FIGS. 1–3, some width of the nips can be obtained by compliant backing layers on image members 101 through 104.

Each of the different color toner images are transferred from their respective image members to the outside surface of intermediate sheet 20 in registration to form a multicolor image. The multicolor image is then transferred and fixed to a receiving sheet 10 fed from receiving sheet supply 22 into overlying relation with the image on intermediate sheet 20 by heated pressure roller 32 substantially as in the FIG. 3 embodiment. The receiving and intermediate sheets are separated from drum 102 as a sandwich by permanent skive 15 and picked up by transport device 40 as in FIG. 3.

This embodiment creates a three or four color image on less than a single revolution of drum 102 and can therefore be four times as fast as the FIGS. 1–3 structure. It has the known disadvantage of more difficulty in maintaining registration between images for highest quality work compared to the single transfer position embodiment shown in FIGS. 1–3. As with the other embodiments, for highest quality work, receiving sheet 10 has a heat-softenable outer layer. Although it is not absolutely necessary that pressure roller 32 be articulatable, it is still preferred for best overlaying of the leading edges of the sheets.

Figure 5:
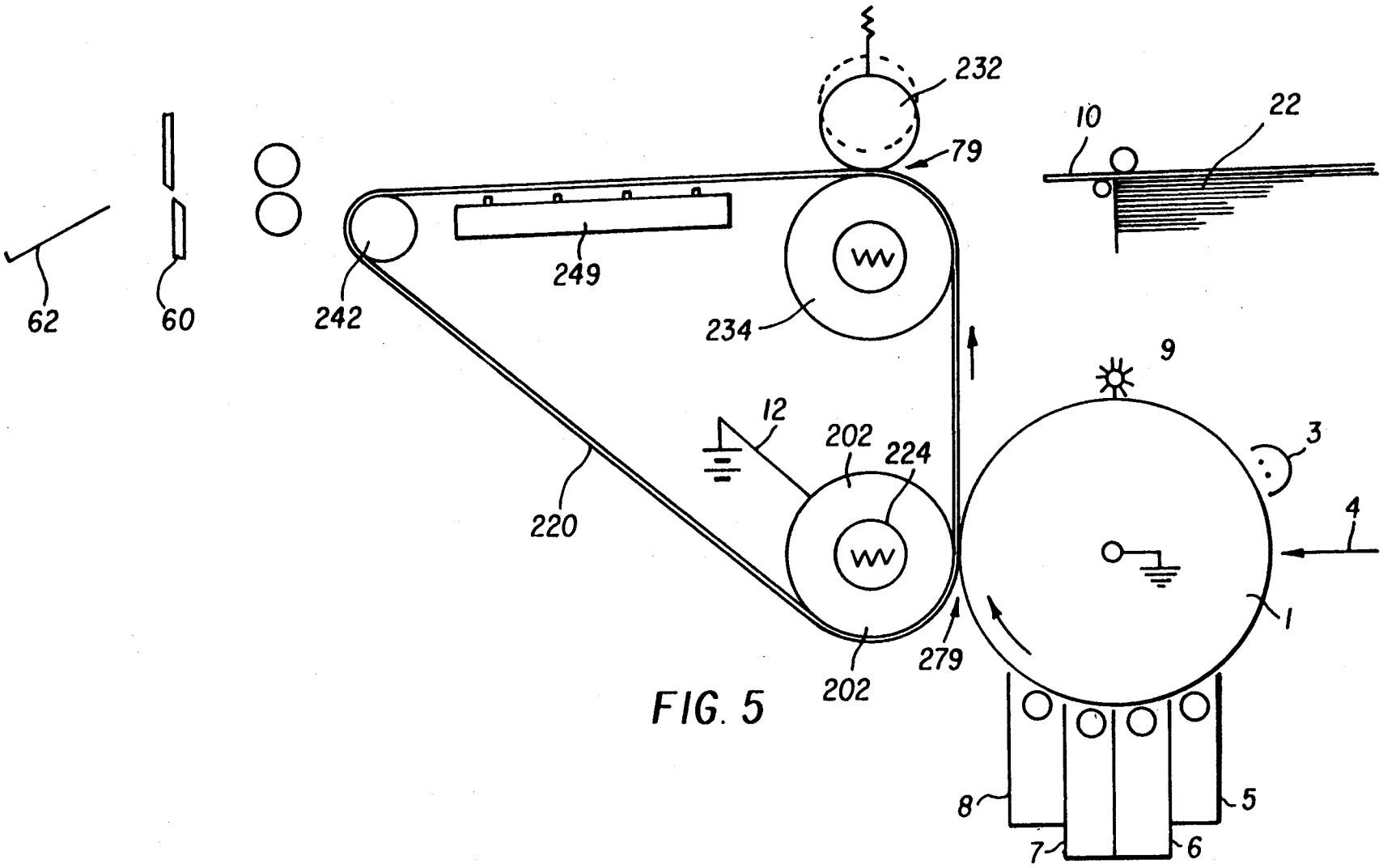

FIG. 5 illustrates use of an endless belt intermediate which does not have the advantages of separate intermediate sheets illustrated in FIGS. 1–4, but can utilize the advantages of a conductive intermediate with electrostatic and heat assisted transfer. Like the FIGS. 1–4 embodiments, it illustrates the transfer process to be described below. Since it does not include a separate intermediate sheet, it is useful for comparison purposes only with respect to that feature.

According to FIG. 5, image member 1 is constructed as in FIG. 1 and creates a series of different color single color toner images. These images are transferred in registration to an intermediate 220 which is an endless belt made of electroformed nickel. The nickel surface can be covered with a very thin layer of a suitable silicone or fluoride to enhance its release capabilities. The single color toner images are transferred in registration to intermediate 220 under the influence of an electric field from a source of potential 12 and after being heated by contact with intermediate 220. The transfer is performed in a nip 279 between intermediate 220 and image member 1 where image member 220 is backed by a metallic roller 202 having a lamp 224 for heating both roller 202 and intermediate belt 220. A multicolor image is formed on intermediate belt 220 which is transferred at a second roller 234 to receiving sheet 10 fed from receiving sheet supply 22. Receiving sheet 10 is pressed by a pressure roller 232 against intermediate 220 where intermediate 220 is backed by roller 234. Pressure roller 232 is articulatable toward roller 234 after the multicolor image has been formed on intermediate belt 220. Receiving sheet 10 maintains contact with intermediate belt 220 while it is cooled by forced air cooling mechanism 249 along a flat section of the belt travel. The belt is passed around a small roller 242 after the image is sufficiently cool for separation from intermediate belt 220, at which point the stiffness of receiving sheet 10 causes it to separate and pass onto cutter 60 and output tray 62.

Because the cooling section must be of substantial size, this embodiment is not nearly so compact as that of FIGS. 1–4. Thus, belt 220 may be too large for efficiency with single multicolor images. Accordingly, several multicolor images can be made at the same time by, for example, making two or three images of the same color at a time and placing two or three images on belt 220 before the next three images of a different color are formed and transferred to belt 220. Belt 220 would then be, for example, two images in length. Alternatively, belt 220 could be one or two ledger-size images in length and two or four letter-sized images in length and operate at full efficiency in each mode; see, for example, U.S. Pat. No. 4,712,906, Bothner et al.

Again, for highest quality work, receiving sheet 10 can have a thermoplastic outer layer which improves both resolution and gloss in the final image.

Further details and examples of the process of transfer from the image member 1 to the conductive intermediates of all Figs. will now be explained. The apparatus described with respect to FIGS. 1–4 can be used with any hard, smooth surfaced intermediate and with any size toner and still obtain many of the advantages described therein. However, for highest quality work with extremely small toners, a particular transfer process and intermediate is preferred. More specifically, this preferred process is especially usable for transferring toner particles of 5 microns mean diameter or less.

In attempting to transfer extremely small toners, best results have been achieved in the past by transferring directly to a receiving sheet having a heat-softenable outer layer using heat assisted transfer. In this process the outer layer is softened as part of the transfer process and the initial layer or layers of toner partially embed in the heat-softenable layer as part of the transfer process. Subsequent layers are also embedded or fused where the particles touch particles that are, in fact, embedded and also transferred. Although this process is successful over a range of pressures, for highest quality work, quite high pressures are required. For example, transferring four toner images of 3.5 micron toner, depending on the glass transition temperatures of the toner and the thermoplastic layer, may require a pressure of 500 pounds per square inch.

At the same time, the temperature of the heat softenable layer cannot be allowed to get too hot for risk of injury to the photoconductor from which it is being transferred. Also, the toner may get hot where it contacts the photoconductor and fuse to the photoconductor mining transfer efficiency. Controlling the temperature is challenging through a receiving sheet which also contains a certain amount of moisture. The moisture can turn into steam if the temperature gets above 100° C. and blister the sheet while if the temperature is much below 100° C., consistent softening of the thermoplastic layer is difficult to achieve. Preheating the photoconductor can help, but it can only be heated to a temperature that does not damage it.

Using an intermediate which is highly thermally conductive, for example, one made entirely of nickel or of nickel coated stainless steel, requires less energy to heat than a receiving sheet with lower thermal conductivity. Its temperature is much easier to control. However, because the conductive intermediate does not have the affinity for toner that a softened thermoplastic coated receiving sheet has, transfer of the first layer or layers is somewhat more difficult. However, if a thermally and electrically conductive intermediate is used which is heated high enough to heat the toner it touches to its glass transition temperature and an electrical field is also impressed between the intermediate and the image member, transfer efficiency comparable to that with thermoplastic coated receivers is obtained. With most toners, transfer efficiencies of 90–96% are obtained.

With some toners, transfer efficiencies of 99% and higher are obtained.

In addition to greater temperature control, these transfers are obtained at pressures as low as 50 pounds per square inch and lower with a quality comparable to that with the thermoplastic coated receiver at 600 pounds per square inch. This provides substantial improvement in the life of the image member as well as making manufacture and design of apparatus easier. In highest quality work, the high pressure transfer is more susceptible to perturbations that could alter the motion of the image member during exposure adversely affecting an image.

Largely because of the higher thermal conductivity and the ease of control of the temperature, far less energy need be used at the first transfer. For example, using a toner with a glass transition temperature of 66° C., good transfer is effected with an intermediate belt at 70° C. This compares favorably with thermoplastic coated receiver transfer in which a drum is heated to 110°-120° C. to get the same sintering of the toner through a receiver sheet.

Although stainless steel, nickel and aluminum and other metals are preferred for the intermediate, they may be covered with a very thin layer of a conductive release material which has sufficient carbon or other particles in it to make it both heat and electrically conductive. Materials suitable as surface treatments for metal intermediates include low surface energy polymers such as silicones and fluoropolymers containing metal salts as filler particles, like aluminum oxide and carbon, and metal/polymer alloys such as electrodeposited nickel/fluoropolymer coatings. In general, as shown by the examples below, remarkable results are achieved without such release materials.

This particular process is especially useful in transferring toner particles less than 5 microns in mean particle diameter, because such toner particles are virtually impossible to transfer with high efficiency using an electric field alone. As described above, this is due to greater effect on small particles of van der Waals and other similar adhesive forces than the force from an electric field. For that reason, some son of heat assist is necessary with such fine particles. The electric field appears to substitute for the thermoplastic layer on the receiver of the prior heat assisted systems, with the substantial improvements noted.

The following examples illustrate the transfer efficiencies and their sensitivity (or lack thereof) to pressure, temperature and type of toner. Note that while some minimum pressure may be necessary, the actual magnitude does not appear to be important. Note also that although any temperature above the glass transition temperature for the toner would provide good transfer of some toner, temperatures much above such glass transition temperature would adversely affect most photoconductors and cause some toner to stick to the image member. Note, also, the substantial positive effect of the electric field.

EXAMPLES

In all of the following examples an aluminum drum was covered first with a 33 mil thick polycarbonate sheet of 87 shore A hardness and then with an inverse composite organic photoconductor element. The photoconductor element included conventional conductive and photoconductive layers on a support. The photoconductive layers were charged to between −400 and −450 volts and exposed for two seconds through a 0.7 neutral density filter. The discharged areas of the photoconductor were toned with a magnetic brush at a bias of 45 volts with positively charged cyan toner. Three cyan toner images so formed were transferred on top of each other to a nickel sheet wrapped around a metallic drum. The examples were repeated under varying heat, pressure, and electric field conditions. The results are tabulated as follows:

| EXAM. | TONER | TRANS. DRUM TEMP. °C. | ELECTRIC FIELD IN VOLTS | TRANS. # | PLI | % TRANS. |
|---|---|---|---|---|---|---|
| 1 | #1 | 100 | −400 | 1 | 30 | 93 |
| | | 100 | −400 | 2 | 30 | 92 |
| | | 100 | −400 | 3 | 30 | 91 |
| 2 | #1 | 100 | −400 | 1 | 30 | 95 |
| | | 105 | −400 | 2 | 30 | 97 |
| | | 110 | −400 | 3 | 30 | 93 |
| 3 | #2 | 100 | −400 | 1 | 30 | 95 |
| | | 100 | −400 | 2 | 30 | 97 |
| | | 100 | −400 | 3 | 30 | 99 |
| 4 | #2 | 100 | 0 | 1 | 30 | 93 |
| | | 100 | 0 | 2 | 30 | 93 |
| | | 100 | 0 | 3 | 30 | 94 |
| 5 | #3 | 100 | −400 | 1 | 30 | 97 |
| | | 100 | −400 | 2 | 30 | 96 |
| | | 100 | −400 | 3 | 30 | 95 |
| 6 | #2 | 70 | −450 | 1 | 30 | 100 |
| | | 70 | −450 | 2 | 30 | 99 |
| | | 70 | −450 | 3 | 30 | 98 |
| 7 | #2 | 80 | −450 | 1 | 30 | 99 |
| | | 80 | −450 | 2 | 30 | 99 |
| | | 80 | −450 | 3 | 30 | 99 |
| 8 | #2 | 90 | −450 | 1 | 30 | 99 |
| | | 90 | −450 | 2 | 30 | 99 |
| | | 90 | −450 | 3 | 30 | 99 |
| 9 | #2 | 100 | −450 | 1 | 30 | 99 |
| | | 100 | −450 | 2 | 30 | 99 |
| | | 100 | −450 | 3 | 30 | 99 |
| 10 | #2 | 90 | 0 | 1 | 30 | 94 |
| | | 90 | 0 | 2 | 30 | 93 |
| | | 90 | 0 | 3 | 30 | 90 |
| 11 | #4 | 90 | −450 | 1 | 30 | 97 |

-continued

| EXAM. | TONER | TRANS. DRUM TEMP. °C. | ELECTRIC FIELD IN VOLTS | TRANS. # | PLI | % TRANS. |
|---|---|---|---|---|---|---|
| | | 90 | −450 | 2 | 30 | 96 |
| | | 90 | −450 | 3 | 30 | 93 |
| 12 | #2 | 80 | −450 | 1 | 15 | 99 |
| | | 80 | −450 | 2 | 15 | 98 |
| | | 80 | −450 | 3 | 15 | 97 |
| 13 | #2 | 80 | −450 | 1 | 20 | 98 |
| | | 80 | −450 | 2 | 20 | 99 |
| | | 80 | −450 | 3 | 20 | 99 |
| 14 | #2 | 80 | −450 | 1 | 25 | 99 |
| | | 80 | −450 | 2 | 25 | 100 |
| | | 80 | −450 | 3 | 25 | 99 |
| 15 | #2 | 80 | −450 | 1 | 30 | 99 |
| | | 80 | −450 | 2 | 30 | 99 |
| | | 80 | −450 | 3 | 30 | 99 |

The pressure is given in pounds per linear inch. A pressure of 20 pounds per linear inch corresponds roughly to a peak pressure of 200 pounds per square inch in such a nip. The electrical field is created by biasing the metallic transfer drum and grounding the conductive layer of the photoconductive element. The toners are

#1 A limited coalescence latex toner having a mean diameter of 3.8 microns in a milled Piccotoner 1221 binder.
#2 A limited coalescence toner having a mean diameter of 3.5 microns in a Piccotoner 1221 binder with a silica surface treatment. (This toner is further described with respect to examples 16–24.)
#3 A limited coalescence latex toner having a mean diameter of 3.5 microns with a low molecular weight polystyrene binder.
#4 Same as #2 without silica coating.

The percent of toner transferred was measured by transferring both the transferred image(s) and the residual image on the photoconductor to separate receiving sheets. The reflection density of the images on the receiving sheets was measured by an X-rite densitometer and compared.

An additional set of examples, 16–24, were run in which only a single toner transfer was done and measured by the same procedure, illustrating two additional toners, each with different coatings and compared to toner #2.

| Example | Toner | Temperatures °C. | % Transfer |
|---|---|---|---|
| 16 | 2 | 70 | 99 |
| 17 | 5 | 70 | 97 |
| 18 | 6 | 70 | 95 |
| 19 | 2 | 80 | 99 |
| 20 | 5 | 80 | 98 |
| 21 | 6 | 80 | 94 |
| 22 | 2 | 90 | 99 |
| 23 | 5 | 90 | 98 |
| 24 | 6 | 90 | 95 |

Examples 16–24 were all carried out with a field of −450 volts, pressure of 20 pounds per linear inch and at 4 inches per second.

Toners #2, 5 and 6 are powder compositions which comprise core particles of small particle size that are coated with minute transfer-assisting particles of colloidal silica, colloidal polymer or colloidal alumina. The core particles, of which a thermoplastic binder polymer is the major component, are pigmented and contain an ionic charge control agent. The transfer-assisting particles can be from 0.01 to 0.2 microns in size and are uniformly distributed upon the surface of the toner. They are the subject of cofiled patent application Ser. No. 07/843,664.

Preferably, the binder polymer is a low molecular weight styrene-butyl acrylate copolymer, such as Piccotoner 1221* polymer supplied by Hercules Co. The pigment is bridged aluminum phthalocyanine. The core particles of 3.5 microns average diameter are made by the evaporative limited coalescense process disclosed in U.S. Pat. No. 4,833,060, which patent is incorporated herein by reference.

The core particles of the toner have an overcoat which makes up about 3 wt. % of the coated particles and which is formed by coating the particles with an aqueous dispersion of the selected colloidal-size material. Following are examples of useful procedures and materials for coating the core particles.

Toner #2—To a 40-g portion of the core toner particles in a blender is added dropwise 29.2 g of an aqueous colloidal dispersion of silica containing 4% solids by weight. The latter is prepared by dilution of Nalcoag 1060* silica, a 50% by weight dispersion of silica having an average particle size of about 0.060 microns. After agitation for about 30 min., the coated toner is dried at room temperature.

Toner #5—A 40-g portion of core toner particles in a blender is treated with a mixture of 50 g of a monodisperse latex of styrene-sodium styrenesulfonate copolymer (2.4% solids by weight; average particle size about 0.1 microns) and 7 g of water. After brief further agitation, the coated toner is dried for 30 min. under vacuum in a microwave oven at 30% power to prevent fusion of the toner particles.

Toner #6—As in Toner #2 above, 24 g of an aqueous dispersion of aluminum oxide containing 5% solids by weight (Aluminum Oxid C*, from Degussa Corp.) diluted with 16 g of water is added to 40 g of the core toner particles in a blender. After brief further agitation, the coated toner is dried as with Toner #5, above.

From the examples it can be seen that the process gives good results with a variety of toners having a particle size less than 5 microns. It is effective at significantly lower temperatures and pressures than is transfer to a paper or transparency stock receiving sheet even if the receiving sheet is covered with a heat-softenable layer of thermoplastic material using no electrical field.

The highest transfer efficiencies were obtained with toners #2 and 5, especially #2 which provided transfer efficiencies approaching 100%. This is a truly remarkable result.

To take fullest advantage of the greater temperature control available with this method, it is preferred that the glass transition temperature of the toners be fairly low, for example, between 55° and 70° C. Good transfer can be obtained less than 10° above this glass transition temperature. Although good transfer can also be obtained at 90° or 100° C., using these higher temperatures is more likely to damage the image member if the temperature is poorly controlled. Toner #2 in the above examples has a glass transition temperature about 60° C. Similarly, although the method will work at higher pressures, there are substantial system advantages to maintaining the pressure below 300 psi and less. The method will work at 100 psi.

In examples 1–15, after the three images were transferred, the nickel sheet was removed, overlaid with a high quality laser print paper receiving sheet and fed by hand through a pair of fusing rollers, both of which were heated. The sheets were allowed to cool and were then separated with the three images stored in overlapping relation on the receiving sheet. Measurements to determine transfer efficiency were done with these images.

The transfer of the multicolor image formed on the intermediate to the receiving sheet is similar to transfusing or transfixing processes in the prior art. For ordinary transfer to a paper receiving sheet, ordinary fusing temperatures and pressures can be used.

As mentioned above, it is best to allow the toner image to cool before separation from the intermediate. This eliminates the need for release oils which can interfere with highest quality transfer from the image member and adversely affect the image.

If highest quality work is to be done, the second transfer is best made to a receiving sheet having a heat-softenable thermoplastic outer layer. Preferably, that layer is preheated to its softening point. Higher pressures are desired than with ordinary fusing, for example, pressures substantially in excess of 100 pounds per square inch. Again, for highest quality images, the receiving sheet and the intermediate should be left in contact until both the image and the thermoplastic layer have cooled below their softening temperatures, as shown in FIGS. 1–5.

The invention has been described in detail with particular reference to a preferred embodiment thereof, but it will be understood that variations and modifications can be effected within the spirit and scope of the invention as described hereinabove and as defined in the appended claims.

We claim:

1. An image forming apparatus comprising:
an image member,
means for forming an electrostatic image on said image member,
means for toning said electrostatic image to form a toner image on said image member,
means for transferring said toner image to an intermediate sheet,
means for overlaying said toner image on said intermediate sheet with a receiving sheet,
means for heating said toner image and for urging said sheets together with sufficient pressure and heat to transfer and fuse said toner image to said receiving sheet in a single step, said means including means for moving said sheets at a first speed during said single transferring and fusing step,
means for holding said sheets after said single transferring and fusing step while said toner image cools below its glass transition temperature, said holding means including means for either holding said sheets stationary or for transporting said sheets at a second speed less than said first speed, and
means for separating said sheets after said toner image has cooled below its glass transition temperature.

2. An image forming apparatus according to claim 1 further including means for cooling said sheets after said toner image has been transferred and fused to said receiving sheet and before said sheets are separated.

3. An image forming apparatus according to claim 1 wherein said means for forming an electrostatic image includes means for forming a plurality of electrostatic images, said toning means includes means for applying toners of different colors to said images to create a plurality of different color toner images, and said means for transferring to said intermediate sheet includes means for transferring said toner images in registration to said intermediate sheet to create a multicolor image.

4. An image forming apparatus according to claim 3 further including a transfer member and means for securing said intermediate sheet to said transfer member, said transfer member being movable to move said intermediate sheet through transfer relation with said toner images at said first speed.

5. An image forming apparatus according to claim 4 wherein said means for heating and urging include a pair of rollers which are rotatable to drive said sheets at said first speed.

6. An image forming apparatus comprising:
one or more image members,
means for forming a plurality of single color, different color toner images on said one or more image members,
means for feeding an intermediate sheet having a leading and a trailing edge and a surface for receiving toner images into transfer relation with said one or more image members,
means for transferring said toner images in overlying registration to said toner image receiving surface of said intermediate sheet to create a multicolor image thereon, said means including means for heating said intermediate sheet to at least the glass transition temperature of said toner images,
means for feeding a receiving sheet into overlying relation with said multicolor image on said intermediate sheet,
means for heating said multicolor toner image and for applying a force urging said intermediate sheet and receiving sheet together with pressure sufficient to transfer said multicolor image to said receiving sheet while said toner image is at or above its glass transition temperature, said force applying means including a pair of pressure members forming a nip through which said intermediate sheet and said receiving sheet are fed, one of said pressure members contacting said intermediate sheet, and
means for separating said receiving sheet and intermediate sheet after the trailing edge of said intermediate sheet has left contact with said one pressure member, and said toner image has cooled below its glass transition temperature.

7. An image forming apparatus according to claim 6 further including means for applying an electrical field between said intermediate sheet and said one or more image members urging transfer of the toner images to the intermediate sheet.

8. An image forming apparatus according to claim 7 further including a supply of intermediate sheets and means for feeding said intermediate sheet back into said supply after separation from said receiving sheet.

9. An image forming apparatus according to claim 8 wherein said intermediate sheets in said supply are electrically and thermally conductive.

10. An image forming apparatus according to claim 9 wherein said intermediate sheets are substantially metallic.

11. An image forming apparatus according to claim 7 wherein said image receiving surface of said intermediate sheet is hard and smooth.

12. An image forming apparatus according to claim 6 wherein said intermediate sheet is substantially metallic.

13. An image forming apparatus according to claim 6 wherein said image forming apparatus includes only one image member and said means for forming a plurality of single color different color toner images, includes means for forming a series of single color different color toner images on said one image member and wherein said image forming apparatus further includes means for bringing the image receiving surface of an intermediate sheet repeatedly into transfer relation with said image member to receive said series of toner images in registration.

14. An image forming apparatus according to claim 6 wherein said apparatus includes a plurality of image members and said means for forming color toner images includes means for forming a different color image on each of said image members and wherein said image forming apparatus further includes means for bringing said intermediate sheet sequentially through transfer relation with said image members to receive said different color toner images in registration on its image receiving surface.

15. An image forming apparatus according to claim 6 further including a transfer drum and means for attaching an intermediate sheet to said transfer drum, said drum being rotatable to bring said receiving surface of said intermediate sheet through transfer relation with said one or more image members to receive said different color toner images in registration.

16. An image forming apparatus according to claim 15 wherein said means for urging said receiving sheet and intermediate sheet together includes said transfer drum.

17. An image forming apparatus according to claim 16 wherein said transfer drum is internally heated which internal heat supplies a substantial portion of the heat for both said transfers of toner images from said one or more images members and also for maintaining said toner images at or above the glass transition temperature while said force urging the receiving sheet and intermediate sheets together is applied.

18. An image forming apparatus according to claim 17 wherein said means for urging said sheets together includes a heated roller which is urged toward said transfer drum while said sheets are between said roller and drum.

19. An image forming apparatus according to claim 6 wherein said urging means also includes means for transporting said sheets at a first speed and said image forming apparatus further includes means for transporting said sheets away from said urging means at a second speed slower than said first speed.

20. An image forming apparatus according to claim 19 including means for cooling said sheets while being transported away from said urging means.

21. An image forming apparatus comprising:

an image member, means for forming a series of electrostatic images on said image member, means for applying different color toners to said series of electrostatic images to form a series of different color single color toner images, a transfer drum, a supply for holding at least one intermediate sheet, said intermediate sheet having an image receiving surface and leading and trailing edges, means for feeding an intermediate sheet from said intermediate sheet supply onto the periphery of said transfer drum, means for holding said intermediate sheet on the periphery of the transfer drum, means for rotating said transfer drum to bring the image receiving surface of the intermediate sheet repeatedly into contact with toner images on said image member, means for transferring said toner images in registration to said receiving surface to form a multicolor image, said transferring means including, means for internally heating said transfer drum to a temperature sufficient to heat the intermediate sheet to a temperature sufficient to raise the toner images to their glass transition temperature when contacted by said intermediate sheet without damaging the image member, means for applying an electric field of a direction urging transfer of said toner images from said image member to said image receiving surface of said intermediate sheet, means for separating said intermediate sheet from said transfer drum, means for overlaying said multicolor toner image on said image receiving surface with a receiving sheet either before or after said intermediate sheet is separated from said transfer drum, roller means for applying pressure to said receiving and intermediate sheets and for maintaining the temperature of said toner image at or above its glass transition temperature to transfer said toner image to said receiving sheet and fuse it thereto in a single step, means for transporting said sheets away from said roller means sufficiently to allow said toner image to cool below its glass transition temperature, and means for separating said sheets after said toner image has cooled below its glass transition temperature and for returning said intermediate sheet to said intermediate sheet supply.

22. An image forming apparatus according to claim 21 wherein said roller means includes a pair of rollers at least one of which is heated for receiving said sheets, means for directing said intermediate sheet to said roller means and means for rotating said roller means to both urge said sheets together with sufficient pressure to affect transfer and fusing and to transport said sheets away from said transfer drum.

23. An image forming apparatus according to claim 22 wherein said roller means moves said sheets at the same speed that said transfer drum rotates said intermediate sheet.

24. An image forming apparatus according to claim 23 wherein said means for transporting said sheets away from said roller means includes means for transporting said sheets at a speed less than the speed that said roller means transports such sheets.

25. An image forming apparatus according to claim 21 wherein said roller means includes a heated pressure roller which is urged toward the periphery of said transfer drum when said sheets are between said roller and said transfer drum and wherein a substantial portion of the heat for raising said toner image to its glass transition temperature both for transfer from said image member and for transfer to said receiving sheet is provided by said source of heat positioned internal to said transfer drum.

26. An image forming apparatus comprising:

a plurality of image members, means for foraging a single color toner image on each of said image members with the colors of said toners varying from image member to image member, a cycleable transfer member, a source of at least one intermediate sheet, said intermediate sheet having leading and trailing edges and an image receiving surface, means for feeding an intermediate sheet from said source onto said transfer member, means for heating said intermediate sheet while on said transfer member, means for cycling said transfer member to bring the image receiving surface of an intermediate sheet on said transfer member through transfer relation with each of said image members to receive a different color toner image from each image member, means for separating said intermediate sheet from said transfer member, a source of receiving sheets, means for feeding a receiving sheet from said source of receiving sheets into overlying relation with the multicolor image on said image receiving surface of said intermediate sheet, roller means for applying a force urging said sheets together either before or after said intermediate sheet is separated from said transfer member, while moving said sheets at a first speed, means for maintaining the temperature of said toner image above said glass transition temperature while said sheets are passing through said roller means to transfer said multicolor toner image to said receiving sheet and fuse it thereon, means for feeding said intermediate sheet away from said temperature maintaining means at a second speed, less than said first speed, to allow said toner image to cool below its glass transition temperature, means for separating said sheets after said toner image is cooled below its glass transition temperature, and means for returning said intermediate sheet to said source of at least one intermediate sheet.

27. An image forming apparatus according to claim 26 wherein said transfer member is a transfer drum.

28. An image forming apparatus according to claim 26 wherein said means for feeding said intermediate sheet away from said temperature maintaining means is adapted to feed said intermediate sheet at a slower rate than said intermediate sheet passes through said roller means.

29. An image forming apparatus comprising:

an image member, means for forming an electrostatic image on said image member, means for applying toner to said electrostatic image to form a toner image on said image member, said toner having a glass transition temperature, a source of at least one intermediate sheet having a finite length, said intermediate sheet being substantially metallic and both thermally and electrically conductive, means for bringing said intermediate sheet into transfer relation with said toner image in the presence of an electric field urging transfer of said toner image to said intermediate sheet, means for heating said intermediate sheet to a temperature sufficient to heat said toner image to its glass transition temperature when in transfer relation with said intermediate sheet, the combination of heat and electric field transferring said toner image to said intermediate sheet, means for overlying said intermediate sheet with a receiving sheet, means for urging said sheets together with sufficient pressure to transfer said toner image to said receiving sheet while said toner image is at or above its glass transition temperature, means for moving said sheets away from said urging means a sufficient distance to allow said toner image to cool, and means for separating said intermediate sheet from said receiving sheet after said toner image has cooled below its glass transition temperature.

30. An image forming apparatus according to claim 29 further including means for heating said intermediate sheet and said receiving sheet to maintain said toner image at its glass transition temperature at least until it passes said pressure applying means.

31. A method of forming a multicolor image, said method comprising:

forming a series of single color, different color toner images on one or more image members, transferring said images in overlying registration to a surface of an intermediate sheet to form a multicolor image thereon, said sheet having leading and trailing edges and said surface being hard and smooth, each said transferring step including heating said intermediate sheet to a temperature sufficient to at least sinter portions of said toner image in the presence of an electric field between each said image member and said intermediate sheet of a direction urging the toner image being transferred to transfer to said smooth hard surface, overlaying the multicolor toner image with the receiving sheet, heating the multicolor toner image to at least its glass transition temperature, applying a force to said receiving sheet and intermediate sheet to create pressure sufficient to transfer the heated multicolor image to the receiving sheet while said sheets are moving at a first speed, allowing said sheets to cool while in contact and while said sheets am stopped or moving at a second speed slower than the first speed, and separating said sheets.

32. A method according to claim 31 wherein said receiving sheet has a heat softenable outer layer which is brought in contact with said toner image when said receiving sheet is overlaid said multicolor toner image and said step of heating the multicolor toner image includes heating said multicolor image and said heat-softenable layer to their glass transition temperatures and said step of applying a force to said receiving sheet and intermediate sheet provides sufficient pressure to embed at least part of said multicolor toner image in said heat-softenable layer.

33. The method according to claim 32 wherein said intermediate sheet is conductive.

34. A method according to claim 31 wherein said intermediate sheet is conductive.

35. The method according to claim 34 wherein said intermediate sheet is substantially metallic.

36. An image forming apparatus comprising:

an image member, means for forming a series of electrostatic images on said image member, means for applying different color toners to said series of electrostatic images to form a series of different color single color toner images, a transfer drum, a supply for holding at least one discrete intermediate sheet, the intermediate sheet having an image receiving surface and leading and trailing edges, means for feeding an intermediate sheet from said intermediate sheet supply on to the periphery of said transfer drum, means for holding the intermediate sheet on the periphery of the transfer drum, means for rotating said transfer drum to bring the image receiving surface of the intermediate sheet repeatedly into transfer relation with the series of toner images on said image member, means for transferring the series of toner images in overlying registration to the receiving surface to form a multicolor image, means for positioning a receiving sheet on top of said multicolor toner image on said intermediate sheet, means for applying pressure to said sheets while raising or maintaining the temperature of said multicolor toner image to or above its glass transition temperature to transfer said multicolor toner image to said receiving sheet, means independent of said pressure applying means for transporting said sheets away from said pressure applying means sufficiently to allow said toner image to cool below its glass transition temperature, and means for separating said sheet after said toner image is cooled below said glass transition temperature.

37. An image forming apparatus comprising:

an image member, means for forming a series of different color toner images on said image member, a transfer member, a supply for holding at least one intermediate sheet, said intermediate sheet having an image receiving surface and leading and trailing edges, means for feeding an intermediate sheet from said intermediate supply onto said transfer member, means for holding the intermediate sheet on said transfer member, means for cycling said transfer member to bring the image receiving surface of the intermediate sheet repeatedly into transfer relation with toner images on said image member, means for transferring said toner images from said image members to said image receiving surface in overlying registration to form a multicolor image, means for positioning a receiving sheet on said multicolor image on said image receiving surface before said intermediate sheet is separated from said transfer member, means for applying pressure to said sheets while backed by said transfer member in the presence of sufficient heat to transfer said multicolor toner image to said receiving sheet, means for transporting said sheets away from said pressure applying means sufficiently to allow said toner image to cool below its glass transition temperature, and means for separating said sheets after said toner image has cooled below its glass transition temperature and for returning said intermediate sheet to said intermediate sheet supply.

38. Image forming apparatus according to claim 37 further including means for moving said transfer member at a first speed while said multicolor image is being transferred to said receiving sheet and wherein said means for transporting said sheets away from said roller means includes means for moving said sheets at a second speed which is less than said first speed.

39. Image forming apparatus according to claim 37 wherein said transfer member is a drum and said means for transferring toner images from said image member to said image receiving surface includes means for heating said transfer drum, which heating means is positioned also to provide heat for transfer of said multicolor toner image to said receiving sheet.

* * * * *

UNITED STATES PATENT AND TRADEMARK OFFICE

CERTIFICATE OF CORRECTION

PATENT NO. : 5,428,430

DATED : Jun. 27, 1995

INVENTOR(S) : Muhammad Aslam, et al

It is certified that error appears in the above-indentified patent and that said Letters Patent is hereby corrected as shown below:

Column 20, line 64, delete "am" and substitute —are—.

Signed and Sealed this

Seventh Day of November, 1995

Attest:

Bruce Lehman

BRUCE LEHMAN

Attesting Officer

Commissioner of Patents and Trademarks